US005648790A

United States Patent [19]

Lee

[11] Patent Number: 5,648,790

[45] Date of Patent: Jul. 15, 1997

[54] DISPLAY SCANNING CIRCUIT

[75] Inventor: Sywe N. Lee, Taipei, Taiwan

[73] Assignee: Prime View International Co., Hsinchu, Taiwan

[21] Appl. No.: 350,066

[22] Filed: Nov. 29, 1994

[51] Int. Cl.[6] ..... G09G 3/36

[52] U.S. Cl. ..... 345/58; 345/99; 345/100; 345/197

[58] Field of Search ..... 345/100, 98, 92, 345/99, 58, 197

[56] References Cited

U.S. PATENT DOCUMENTS 5,313,222 5/1994 Lee ..... 345/100
5,440,323 8/1995 Okada ..... 345/100
5,442,372 8/1995 Shiki ..... 345/100
5,461,424 10/1995 Shimizu ..... 345/100
5,510,805 4/1996 Lee ..... 345/100

*Primary Examiner*—Richard Hjerpe
*Assistant Examiner*—Ricardo Osorio
*Attorney, Agent, or Firm*—H. C. Lin

[57] ABSTRACT

A row select driver circuit is used to energize each pixel row sequentially of a liquid crystal display. The output of each row select driver circuit is connected to a corresponding pixel row line and to a succeeding row select driver circuit as an activating input. All the row select circuits are integrated with thin-film transistors and deposited on the same glass substrate as the pixels. The number of leads connected to the assembly is much less than the number of pixel rows, including six overlapping clock signals (three each for odd-numbered rows and even-numbered rows), a shift-in signal, a positive power supply terminal and at least one ground. In one example, the number of leads is reduced from 240 to 10.

15 Claims, 9 Drawing Sheets

DISPLAY SCANNING CIRCUIT

BACKGROUND OF THE INVENTION

This invention relates to a driver circuit for an active matrix display device, and particularly a row select driver circuit for driving the pixel rows of a liquid crystal display (LCD) using thin-film transistors (TFT).

Liquid crystal displays (LCD) or similar devices normally use thin-film MOS transistors deposited on a substrate, usually glass. At present, almost all commerciall available active matrix liquid displays (AMLCD) are unscanned in that the scanning signal is applied external to the AMLCD.

An unscanned AMLCD requires one external lead for each column and row line. For example, a direct line interface driver for a black and white 768X1024 XGA computer display would require 1792 leads. The need for this large number of leads in the display drivers is a serious problem, which gets worse as the resolution and complexity of displays increase. Two major challenges are to reduce the number of required input leads and to "integrate" the driver circuitry onto the display substrate.

U.S. Pat. No. 5,034,735 discloses a driving apparatus using two transistors per pixel row for producing select and deselect signals and sequentially addressing them through the control gates. However, the scanning driver circuit and a signal driver circuit are adapted for a ferroelectric liquid crystal device, not for TFT-LCD.

U.S. Pat. No. 5,157,386 discloses a circuit driving an AMLCD with video digital data of K bits. An analog switch receives a video voltage and outputs the video voltage to each column when the analog signal is turned on by a control signal. This is not a circuit for selectively driving the row of a display.

U.S. Pat. No. 5,113,181 discloses a display, wherein a data driver is used, but does not disclose a scan driver circuit.

U.S. Pat. No. 5,313,222 discloses a select driver circuit for an LCD display, which has to sustain a great deal of electrical stress.

SUMMARY OF THE INVENTION

It is an object of the present invention to reduce the manufacturing cost and to increase reliability by eliminating the need for mounting integrated circuits on a separate substrate. It is another object of the present invention to produce a novel row select driver circuit which can be integrated directly onto the display substrate, thereby eliminating the cost of peripheral ICs and hybrid assembly needed in an unscanned AMLCD. A further object of the present invention is to produce a new integrated row select driver circuit with faster deselect time and full amplitude drive signal.

These objects are achieved by using a row select driver circuit similar to a shift register. Each row select driver circuit energizes a row of pixels. The row select driver circuits are deposited on the glass substrate of the pixels. The output of each row select driver circuit is connected to a corresponding pixel row line and to a succeeding row select driver circuit as an activating input. These row select driver circuits energize the pixel row sequentially. Switching apparatus external to the display device has leads connected to the row select driver circuits wherein the number of leads is far less than the number of pixel rows. In one example, the number of leads is reduced from 240 to 10.

Each of the row select driver includes a number of thin-film transistors formed on the display substrate, and interconnected to cause sequential activation of each pixel row.

A first row select driver circuit stage activates a first pixel row for a first predetermined period of time. A second adjacent row select driver circuit activates a subsequent pixel row for a second predetermined period of time prior to the termination of the first predetermined period of time such that a longer row select time is provided for each row to charge or discharge the pixels of the corresponding pixel row.

DETAILED DESCRIPTION OF THE PREFERRED EMBODIMENT

Figure 1:
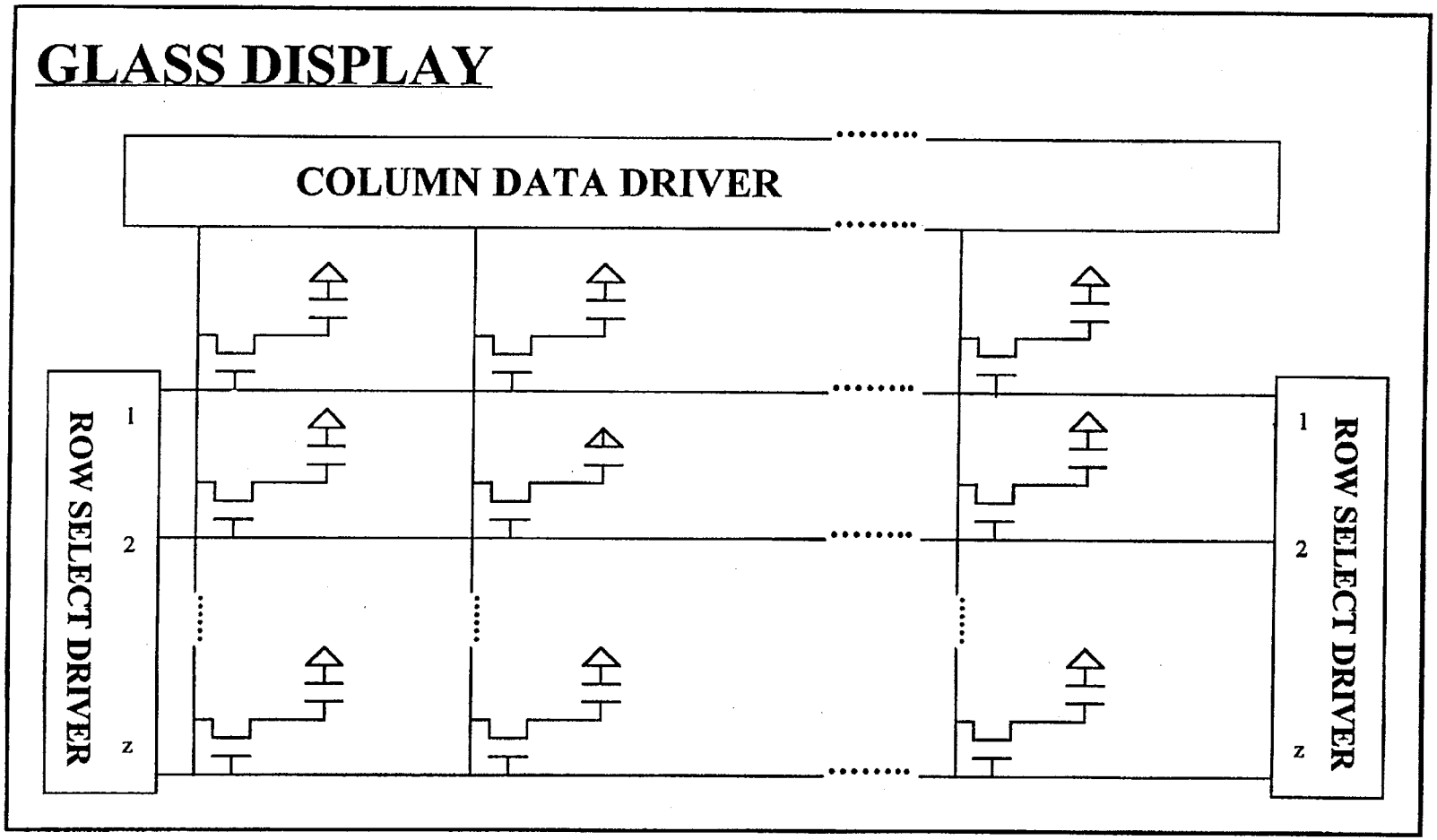
FIG. 1 is a block diagram of a display system in which the row select driver circuit of the present invention may be used.

FIG. 1 shows the block diagram of a display system in which there are a column data driver and a row select driver.

This invention will be described with a 384×240 pixel array color TV as an example. There are two row select drivers shown in FIG. 1, although only one row driver is sufficient. The two row select driver circuits provide circuit redundancy and circuit diagnostics when repairs are needed.

There are 240 identical circuit stages in each row select driver for this example. Each driver circuit is indicated by a rectangular dashed line labeled as stage 1, stage 2, and stage 3 through stage 240. All stages are identical including the stages between stage 3 and stage 240 except where odd (even)-numbered control signals are connected to the odd (even)-numbered stages. The row select driver circuit is preferably fabricated with thin-film transistors (TFT) on the display device substrate to generate scanning signals for the display to turn on and off a selected row of pixel transistors.

This invention is particularly focused on reducing the number of external lead connections to the row driver circuits to 10 from a number such as 240 in the example used. The circuit also solves the problem of using thin-film transistors which are deposited directly on the glass substrate but have poor device performance characteristics such as low mobility, nonuniform threshold voltages and threshold voltage shift.

Figure 2:
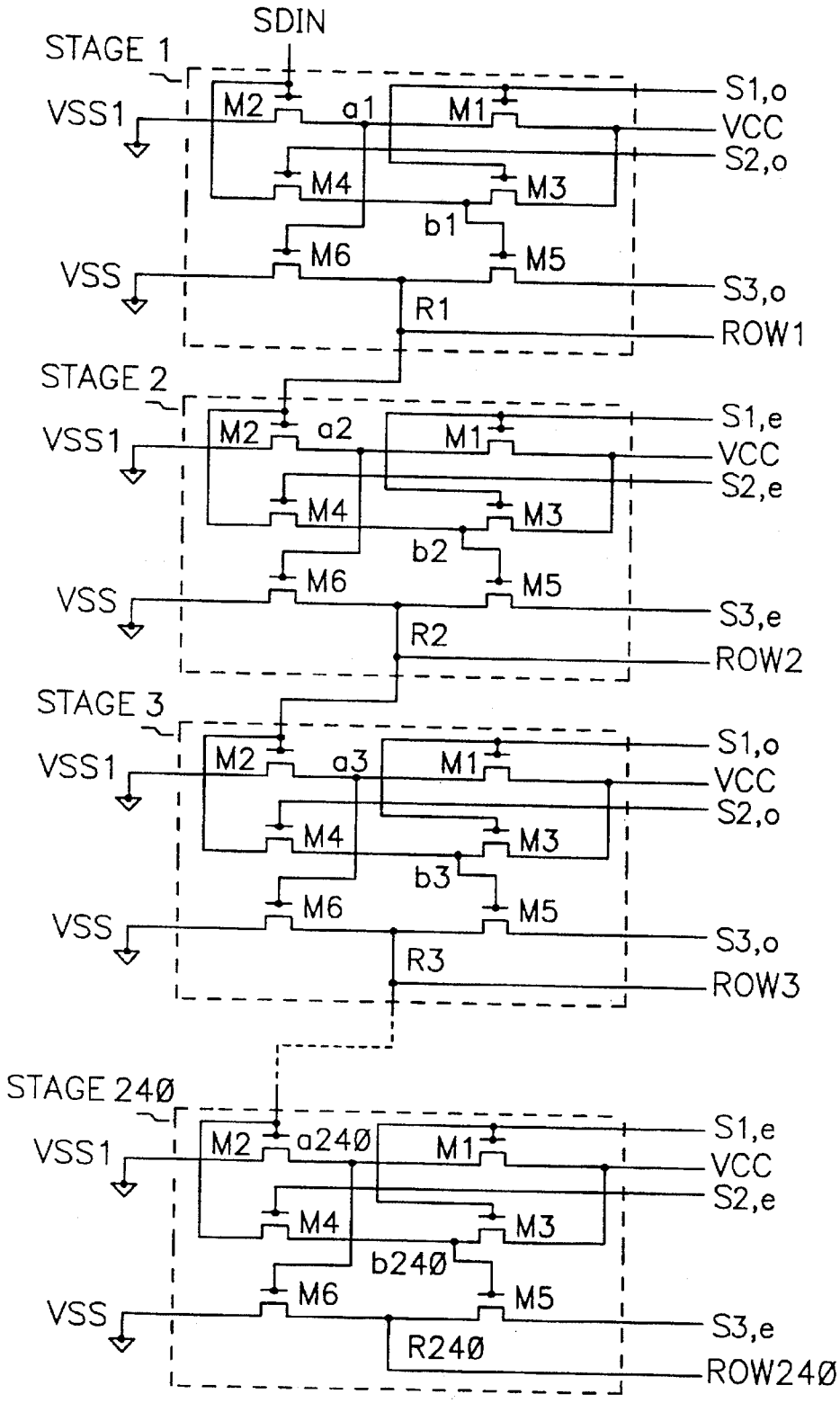
FIG. 2 is a schematic diagram in accordance with the present invention.

As shown in FIG. 2, the row select driver circuit is divided into odd-numbered and even-numbered stages, each stage having six transistors. The output of stage 1, R1, is connected to the first row line of the pixel array and to the input of stage 2 at the gate of the transistor M2 of stage 2. The output of stage 2 is connected to the second row line of the pixel array and to the input of stage at the gate of the transistor M2 of stage 3, and so forth through stage 240. All odd-numbered stages received first, third and fifth control signals S1,o, S2,o and S3,o, respectively. A shift-in signal SDIN is connected to the first stage at the gate of transistor M2 of stage 1 only. All stages are connected to a common positive power supply VCC and two common ground (or negative power supplies) VSS and VSS1. The reason for having two grounds is to shield outputs from noise. Thus, there are 10 input leads from the external driving system connected to the row select driver circuit on the display device, namely: SDIN; S1,o; Si,e; S2,o; S2,e; S3,o; S3,e; VCC, VSS and VSS1. Only these 10 control leads are needed to control 240 row select driver circuits.

Figure 3:
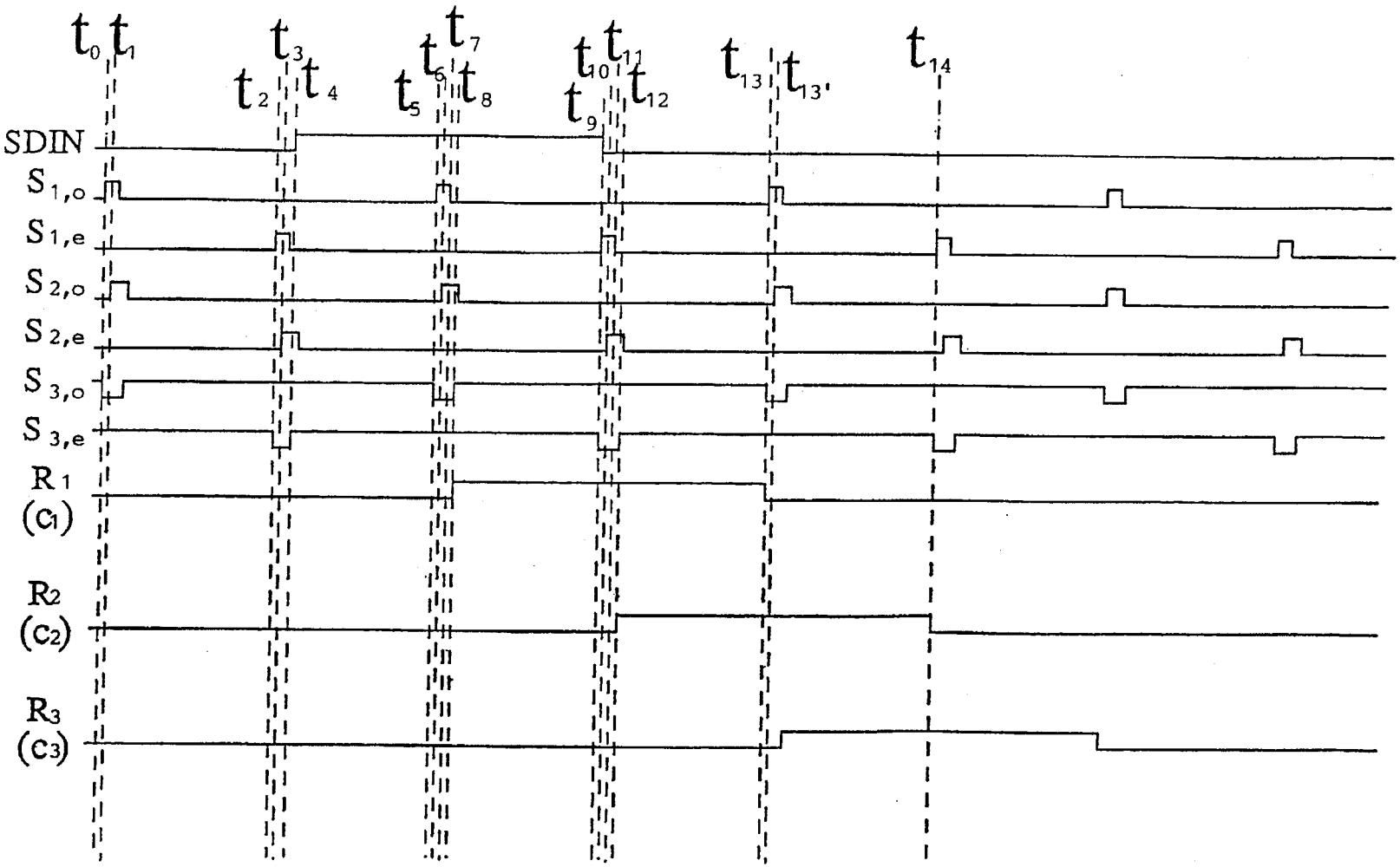
FIG. 3 is a timing diagram of the inputs and outputs to the circuit of FIG. 2.

The waveform of the controlling clock signals and its internal and output nodes are shown in FIG. 3. The control signals, S1,o; S1,e; S2,o; S2,e; S3,o and S3,e have a period which is twice as long as that of the scan time T (e.g. t2-t0) of a horizontal line. The shift-in signal SDIN has a period equal to the frame time. In the NTSC television system, the scan line time and the frame time are approximately 63 us and 16.67 ms, respectively. The output of each stage is connected to a row of the pixel gate line as shown in FIG. 1.

Video information (or other means of input signal to a display) is supplied to the system of FIG. 1 one row at a time. As those who are skilled in the art are aware, the low mobility of the thin-film transistors in FIG. 2 makes it likely that the row-select time is shortened due to the slow charging time of the pixel capacitance from the TFT. In order to achieve a longer row-select time period to charge or discharge of the pixel capacitance, the next adjacent row is activated before the previous row is deactivated. However, only one line of information is provided at one-time period, because only one pixel row is locked in at any given horizontal line-time period. This operation is termed "line preselection". The advantage of the row-select driver circuitry is to reduce the number of external lead connections. In this example, the number of lead connections is reduced from 240 to 10 for the select driver alone. This lead reduction in turn significantly simplifies the display assembly and packaging. Although the novel circuitry requires six transistors per stage, the transistors are relatively small and easy to fabricate on a substrate such as glass. As a result, manufacturing cost is reduced because of the significant reduction of lead connections and fewer external driver chips.

As shown in FIG. 2 and the timing diagram of FIG. 3, at time t0, the signal S3,o is pulsed low and signal S1,o is pulsed high, which turns on transistor M1 and M3 of all the odd-numbered stages, thereby causing all odd nodes a1, a3, . . . a239, and b1, b3, . . . ,b239 to be charged to a voltage level of approximately VDD-Vt (logical "1"), where VDD is the amplitude (high voltage) of S1,o signal pulse and Vt is the threshold voltage of the transistors. AT this instant, the nodes a's and b's in all odd-numbered stages cause transistors M5 and M6 to conduct, resulting in all odd-numbered row scan lines to be discharged to the common ground VSS level (logical "0") since S3,o signal is also at the same ground level as VSS and VSS1 at t0. It should be noted that the the positive amplitude for every control signal is assumed to be equal to VDD, which can be approximately equal to VCC.

AT t1, the signal S2,o is pulsed high which turns on M4 of all odd-numbered stages and the input node SDIN at a low "0" logical level, thereby discharging nodes b's of all odd-numbered stages to an intermediate voltage level between VDD and VSS, because M3 of all odd-numbered stages is also conducting at this instant. The level of the intermediate voltage depends on the transistor sizes of M3 and M4. Nodes b's in all odd-numbered stages return to logical "0" level soon after S1,o returns to logical "0" level, while S2,o remains high.

At time t2, which is delayed from t0 by 63 us, the signal S1,e is pulsed high and the signal S3,e is pulsed low. At time t3, the signal S2,e is pulsed high. These timing sequences for even-numbered stages have not only the same waveforms as counterparts of S1,o, S3,o and S2,o in the odd-numbered stages, but also the same operation as the odd-numbered stages at t0 and t1. From t0 to t3, the changes in nodes b's in all stages have no effect on the output waveform logically, since M5 of all stages are only ON during the period whenever nodes b's are high and the corresponding S3,o and S3,e are at ground level.

At time t4, the shift-in signal SDIN is pulsed high and turns on transistor M2 of stage 1 only, thereby discharging node al to VSS1 level which is logical "0", while a2, a3, . . . , a240 remain high. Then at t5, S1,o is pulsed high to turn on transistors M1 and M3 in all odd-numbered stages, which pull up node a1 to an intermediate voltage level and node b's of all odd-numbered stages to the high voltage level. Since signal S3,o is also at a low voltage level at t5, the output, R1, R3, . . . , R239 remain low.

Odd-numbered nodes b3, b5, . . . , b239 are discharged to an intermediate voltage at t6 due to the fact that both signals S1,o and S2,o are at logical "1" level and output nodes R's in the preceding stages are at ground level which causes transistors M3 and M4 of the odd-numbered stages to turn on. However, M4 in stage 1 is off, since SDIN is high, and b1 remains at a high voltage level. At time t7, the signal S1,o returns to logical "0", which in turn causes odd-numbered nodes b3, b5, . . . , b239 to return to the low voltage ground level, because M3 turns off and M4 is still on in all odd-numbered stages, except stage 1. At this instant, b1 remains high since both M3 and M4 in stage 1 are off and node al returns to the low voltage level by the combined effect of M1 being off and M2 being on.

At time t8, the signal S3,o is raised to the VDD level which pulls up the output node R1 all the way to VDD level since only node b1, at logical "1" level, is able to turn on transistor M5 of stage 1, while b2, b3, b . . . , b240 are all at a logical "0" level. During the period of time at which node R1 is a logical "1" level, all pixel transistors in row 1 of pixel array in FIG. 1 are turned on. Soon after R1 is charged to VDD, a logical "1" level, which turns on M2 of stage 2, node a2 of the second stage is discharged to the VSS1 level.

After a time period of 63us from time t5, at time t9, the control signal S1,e is pulsed high to turn on transistors M1 and M3 of all even-numbered stages. At this instant, with M1 and M2 of the stage 2 conducting (because R1 of the stage 1 is still at a logical "1" level), node a2 is charged to an intermediate voltage level. With M3 on and M4 off in all even-numbered stages, nodes b's of all even-numbered stages are charged to a high voltage level (logical "1"). Again, similar to the odd-numbered stages at time t5, the output nodes R's of all even-numbered stages remain at the low voltage level, since M5 transistors in all even-numbered stages are on and signal S3,e is at a low voltage at t9.

Even-numbered nodes b4, b6, . . . , b240 are discharged to an intermediate voltage at time t10 due to the fact that both signals S1,e and S2,e are at logical "1" level, which causes transistor M3 and M4 of even-numbered stages to turn on, while in stage 2, M4 is off because R1 of the first stage is at a high voltage level and hence b2 remains at the high voltage level. At time t11, signal S1,e returns to logical "0" level, which causes nodes b4, b6, . . . , b240 to be discharged to the low voltage level, since M3 is turned off and M4 is still on in all even-numbered stages, except stage 2. At this instant, node a2 of stage 2 is also discharged to VSS1, since M1 turns off and M2 is still on due to high R1. Node b2 remains high since both M3 and M4 of stage 2 are off.

Similar to stage 1, at time t12, signal S3,e is raised to the VDD level. Since only b2 among all even-numbered b nodes is at logical "1" level, transistor M5 of stage 2 is turned on, which causes the output node R2 to be charged to a logical "1" level. The high R2 level in turn causes all pixel transistors in row 2 of the pixel array in FIG. 1 to turn on. Note that at time t12, both outputs R1 and R2 are at logical "1" level as desired.

Soon after node R2 of stage 2 is at high voltage level, node a3 of stage 3 is discharged to the low voltage level. At time t13, 126us after time t5, control signal S1,o is pulsed high again, turning on M1 and M3 of all the odd-numbered stages. With M1 on in all odd-numbered stages, node a1 is pulled up to the high voltage level, since M2 is off in stage 1, node a3 is charged up to an intermediate level since M2 of stage 3 is also on, and nodes a5, a7, . . . , a239 remain at high voltage level. With M3 on in all odd-numbered stages, nodes b3, b5, . . . , b239 are pulled to high voltage level and b1 remains at high voltage. The sequences of the operation which follows in stage 3 is similar to the operation executed in stage 1 126 us earlier.

At signal S3,o is pulsed low and node b1 and a1 are at logical "1" level at time t13 to turn on transistors M5 and M6, row 1 scan line is discharged to a logical "0" level, thus deselecting row 1 at this instant. Similarly, row 2 is deselected at t14.

Each succeeding row select driver circuit operates in a similar fashion with the output of the previous stage providing an equivalent "shift-in" signal similar to input signal SDIN to the first stage. All the subsequent stages remain in the off condition (ground or logical "0" level) until these stages receive the high output signal from the previous stage. Therefore, the driver circuitry and the control signals during the remaining frame time shift the selection and the deselection of the scanning lines 3 through 240 sequentially in the same manner described above.

Figure 4:
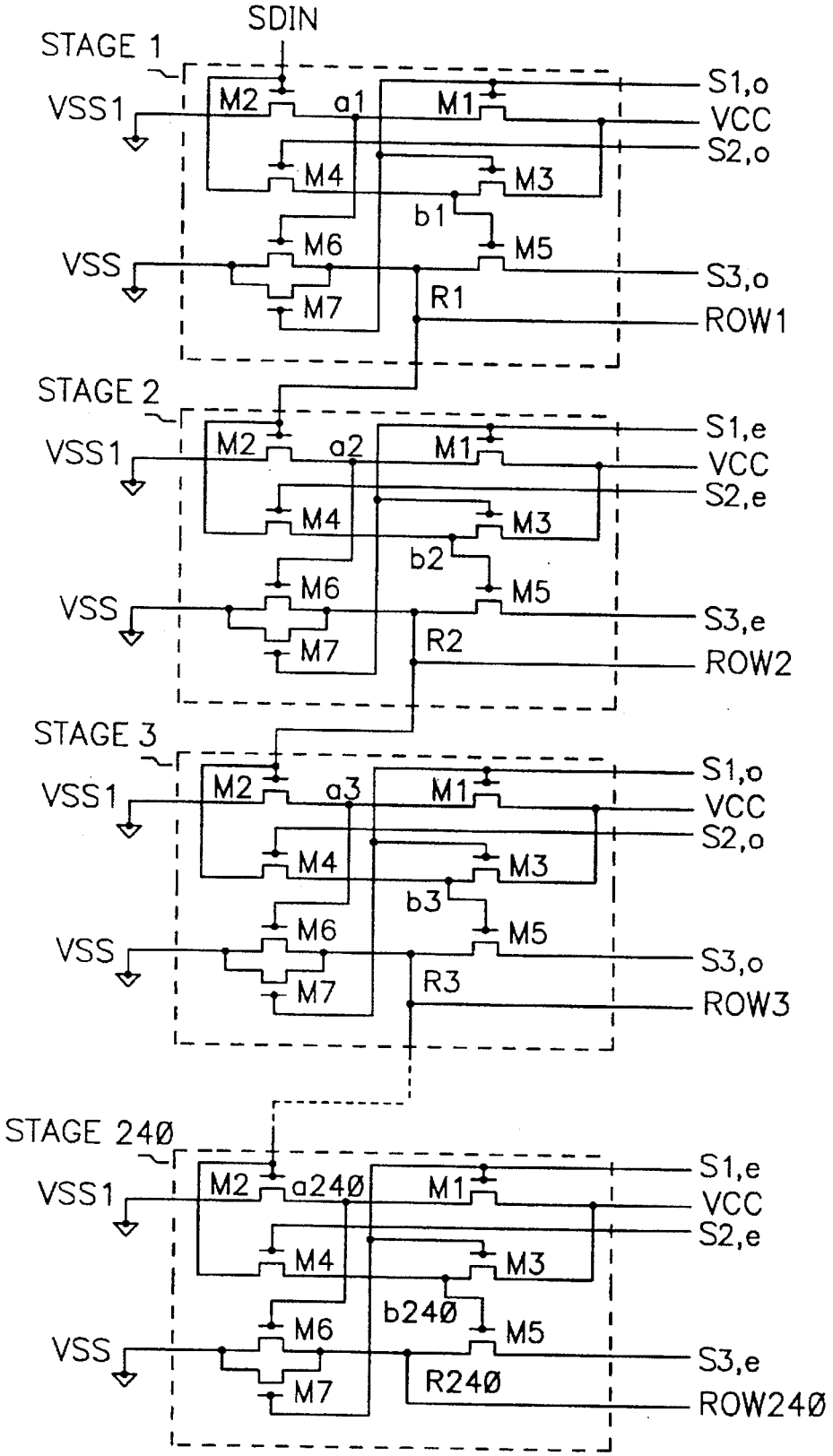
FIG. 4 is a modified version of the schematic shown in FIG. 2.

FIG. 4 shows another embodiment of the present invention. An additional transistor M7 is connected in parallel with M6. The gate of M7 for each odd-numbered stage is connected to the signal S1,o, and the gate of M7 for each even-numbered stage is connected to the signal S1,e. Transistor M7 is used for the purpose of pulling down the row lines faster if a faster deselect time for the pixel row lines is desired. This can be seen at time t13 when M7 is turned on in addition to M5 and M6 to discharge node R1 faster. Similarly, M7 of stage 2 helps node R2 to discharge faster at time t14. Each stage in FIG. 4 has seven transistors.

Another concern for the circuitry in FIG. 2 is that an output node while held at low voltage level by turning on M6 can experience a disturbance whenever M4 of the following stage is turned on by either S2,o or S2,e. This is not desirable, because any disturbance noise of a row select line can couple to the pixel electrodes. In an extreme case when the peak voltage of the noise is above the thresheld voltage of the pixel transistors, the pixel transistors may prematurely turn on. One way to tackle this problem is to make the transistor size of M6 much larger than M4. However, it is sometimes not practical to realize very large size ratio.

Figure 5:
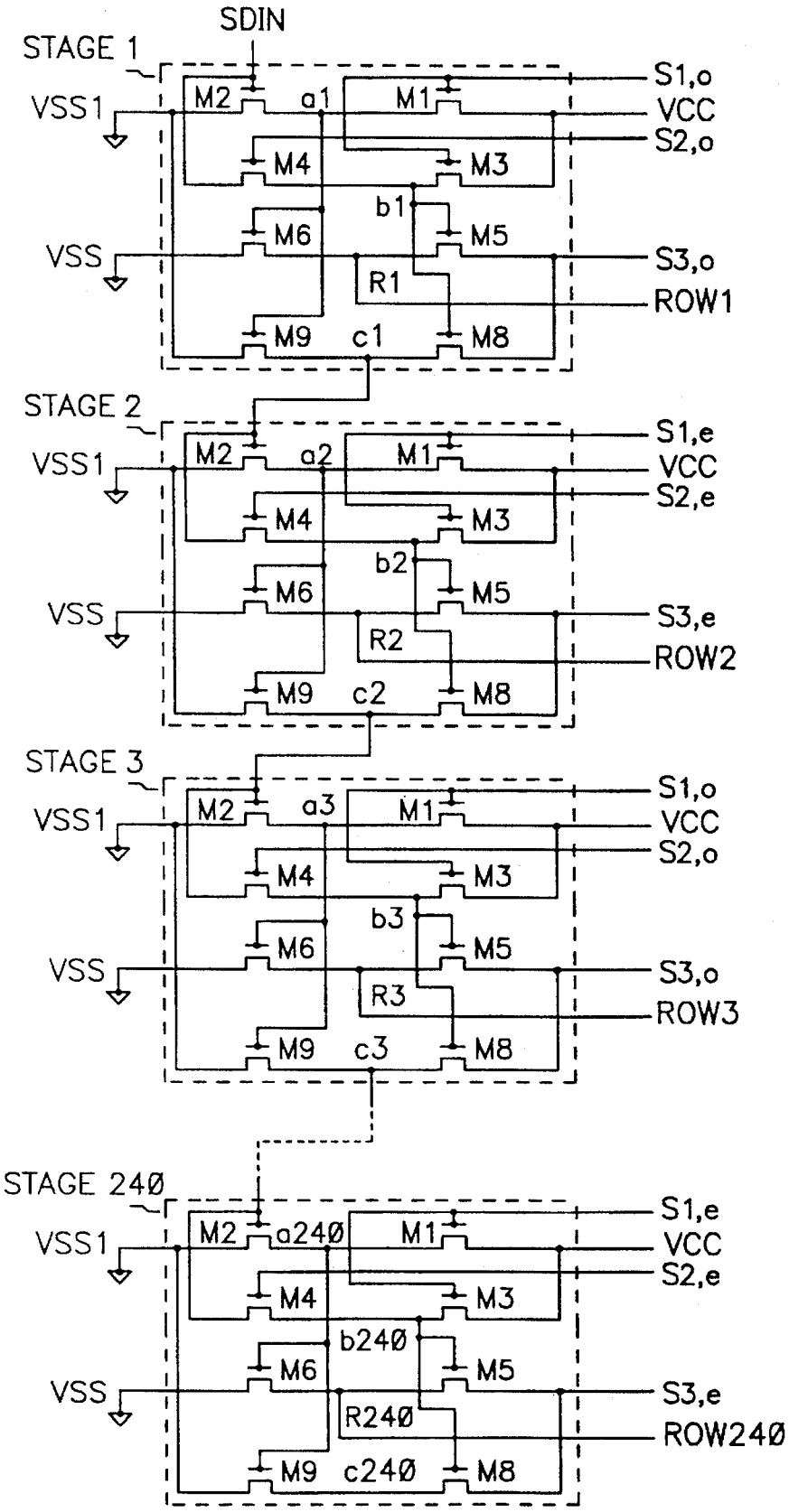
FIG. 5 is another modified version of the schematic diagram shown in FIG. 2.

Another embodiment of this invention to overcome this noise problem is shown FIG. 5. Two more transistors M8 and M9 are added to the circuit in FIG. 2. Instead of connecting the output row line directly to the M2 and M4 of the following stage as shown in FIG. 2, a new node c which has the same waveform logically as the output node R of the same stage is used for connecting to the following stage as shown in FIG. 5. As it can be seen from FIG. 5, transistor M8 (M9) is a parallel connection of M5 (M6) except that the common node c of M8 and M9 is separated from the common node R of M5 and M6. Therefore, nodes R's can be shielded from the noise in nodes c's. In this manner, the noise in node c does not affect the pixel electrodes of the row line, since node c is not connected to the pixel row. Every stage of the driver circuit shown in FIG. 5 now has eight transistors.

Figure 6:
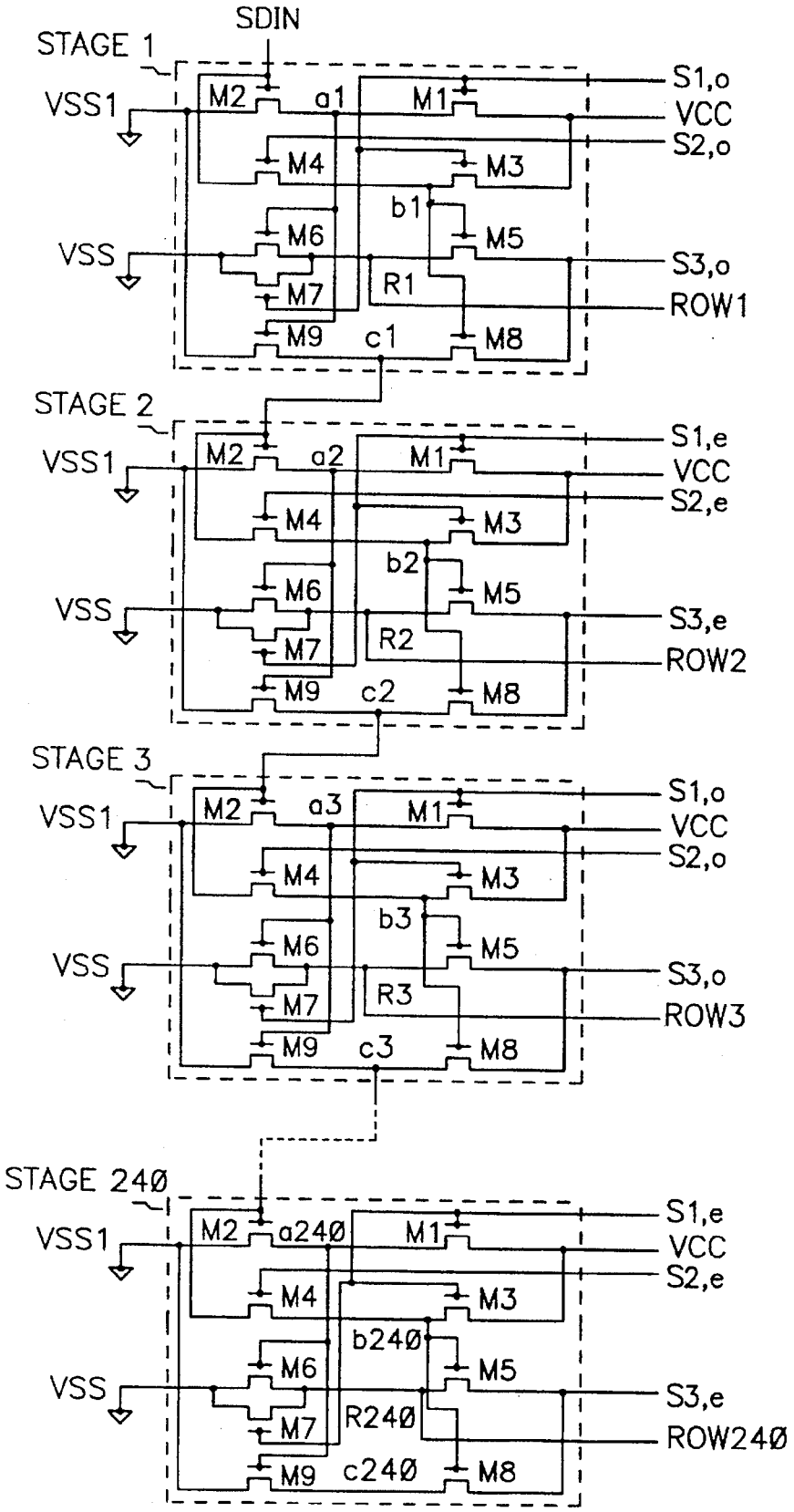
FIG. 6 is a schematic diagram which is a combination of the circuits shown in FIGS. 4 and 5.

FIG. 6 shows a circuit which combines the features of FIG. 4 and FIG. 5. Thus, an improved noise-immune output with faster deselect time can be obtained with the circuit shown in FIG. 6 having nine transistors.

Figure 7:
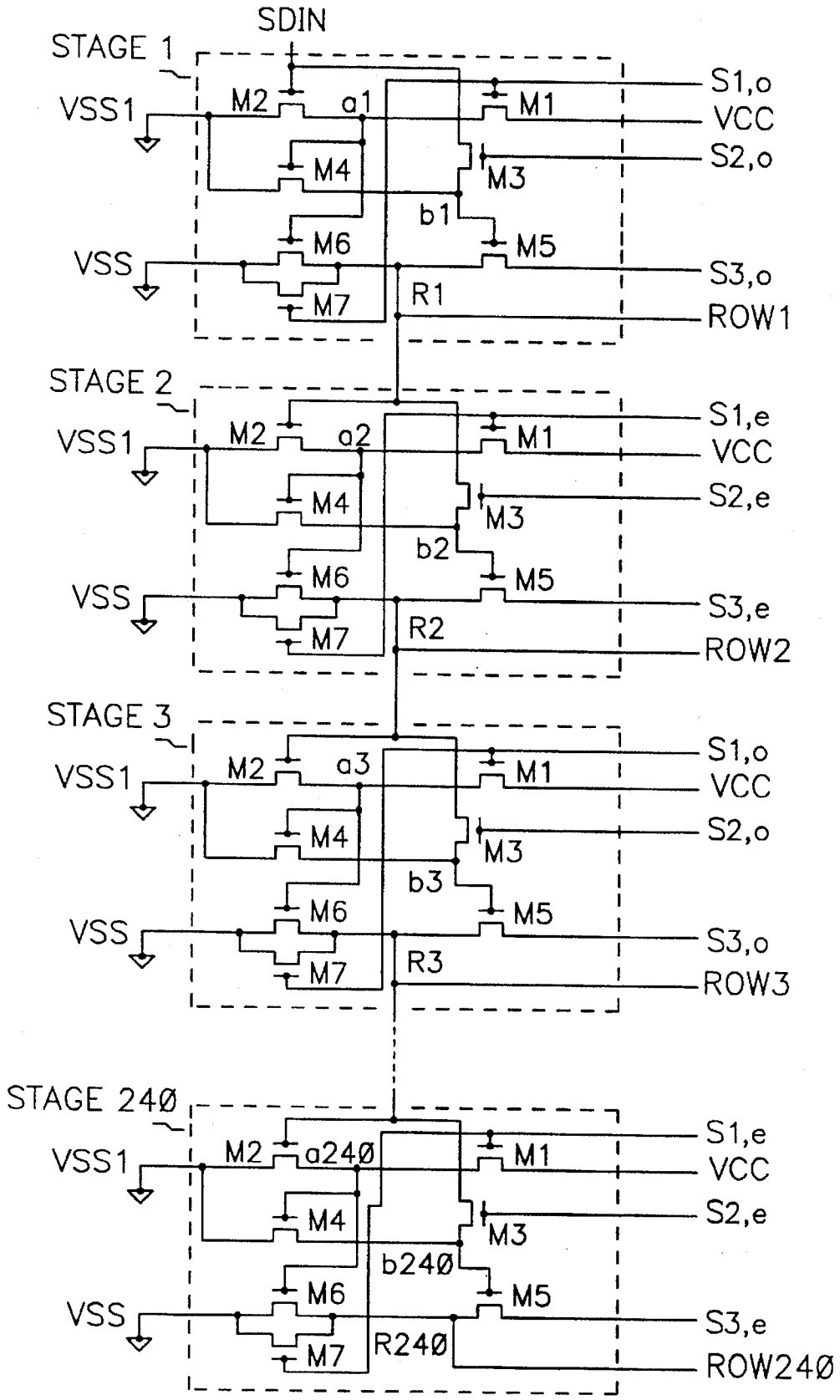
FIG. 7 is a modified version of the schemetic diagram shown in FIG. 4.

FIG. 7 shows a circuit diagram which generates similar output waveforms as the circuit shown in FIG. 4 by utilizing the same input signals. The only differences between the circuit diagrams of FIG. 4 and FIG. 7 are the connections of M3 and M4. The signals a's and the outputs generated by the circuit in FIG. 7 are similar to the circuit in FIG. 4. However, the waveform of node b on each stage in the circuit of FIG. 7 is deviated from the circuit in FIG. 4. This can be seen, as an example, in stage 1. Node b1 is pulled high for the circuit of FIG. 7 at t6 while S2,o is pulsed high, instead of t5 while S1,o is pulsed high as described in one of the preceding paragraphs. At time t13', 126 us after t6, node b1 is discharged to the low voltage level since SDIN is at the low voltage and S2,o is pulsed high again at this instant. Because b1 is at a logical "1" level between t6 and t13', the output node R1 is pulsed high during the time between t8 and t13 which is the same as described previously. Similarly, stage 2 is operated in the same manner except delayed by 63us. Further down, stage 3 through 240 are similarly operated in sequence.

Transistor M4 on each stage in FIG. 7 is used for holding node b to logical "0" level so that no coupling effect can affect node b. This can again be demonstrated using stage 1 as am example. Outside of duration between t4 and t13' while node a1 is at the high voltage level which turns on M4, node b1 can be kept at the low voltage level so that any coupling signal to node b1, which can affect the output R1, is eliminated. Also, the noise, which appears at the output node R when M6 of the present stage and M4 of the following stage are turned on simultaneously as in the circuit of FIG. 4, can be eliminated in the circuit of FIG. 7 if an output node R is connected to the input of the following stage.

Figure 8:
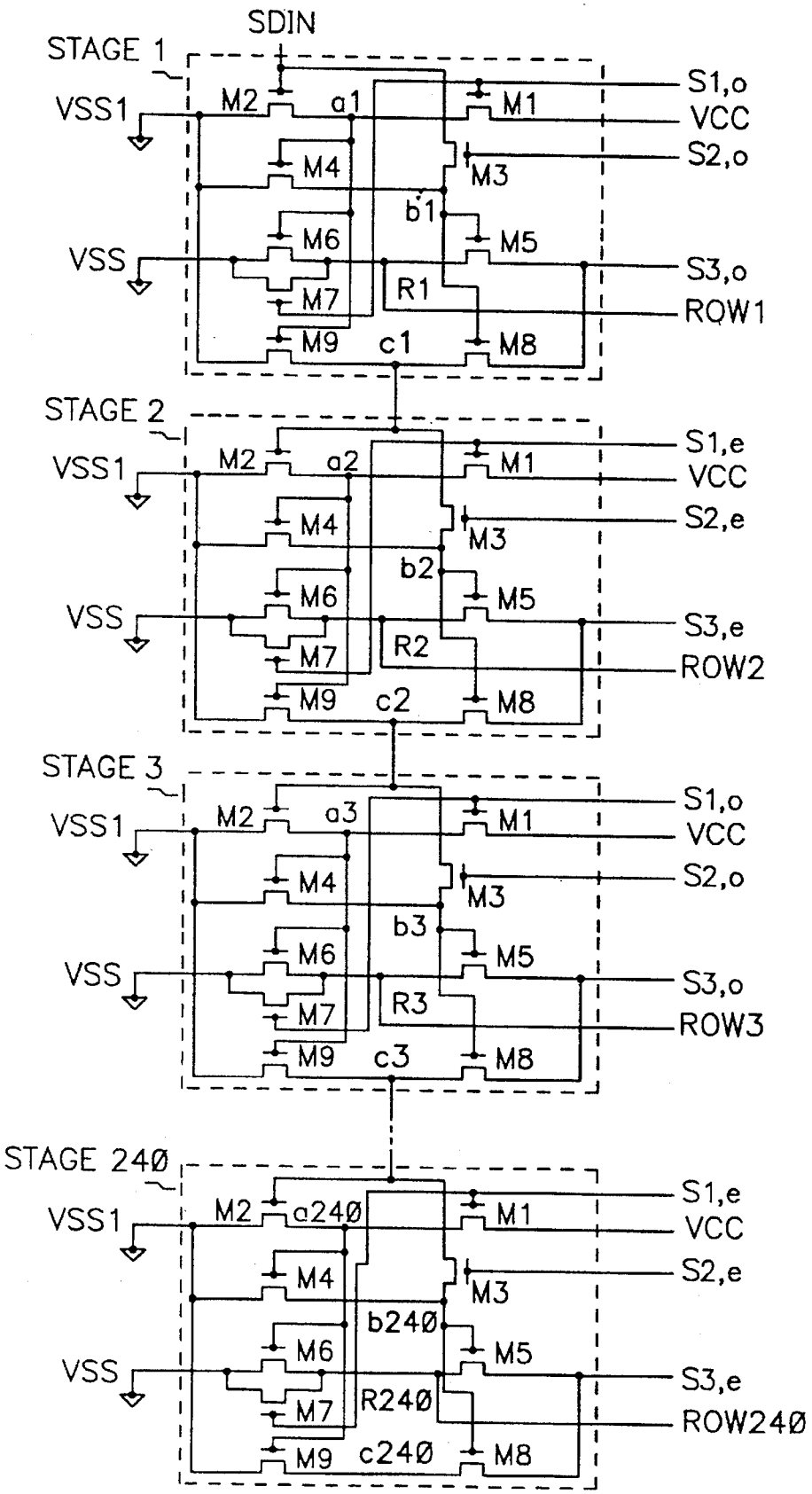
FIG. 8 is a modified version of the schematic diagram shown in FIG. 7.

The reason to add M8 and M9 to each stage of the circuit FIG. 7, which is shown in FIG. 8, is to eliminate any disturbance to an output node when it is at the high voltage level. This can be demonstrated by the operation described below, At time t10, S2,o is pulsed to the high voltage level. This can disturb the output node R1, which is not desirable, because node b2 is at the low voltage level and the output R1 is at the high voltage level at the moment just before t10. Therefore, M8 and M9 are added to each stage of the circuit to shield the output node from noise.

Figure 9:
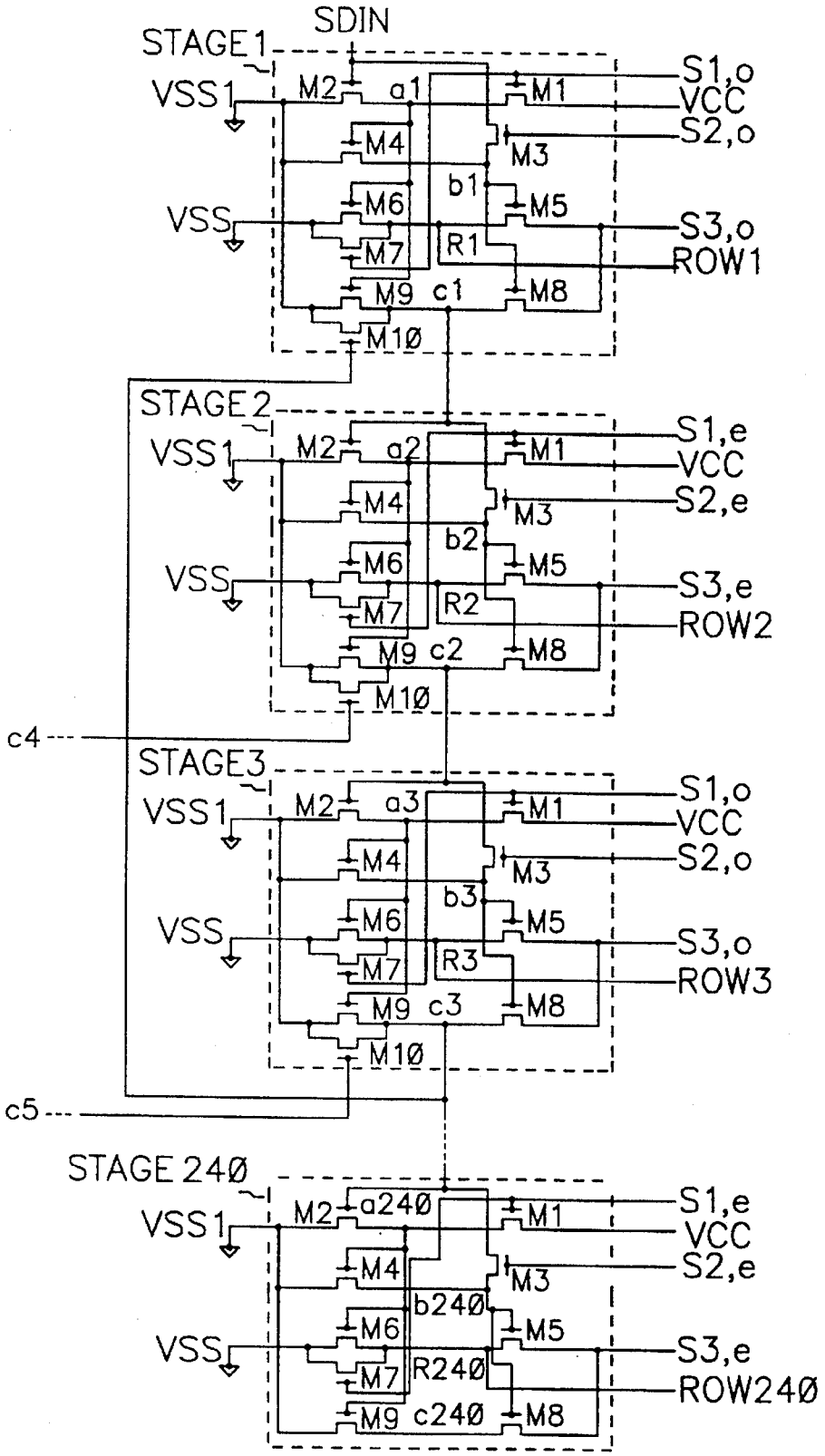
FIG. 9 is a modified version of the schematic diagram shown in FIG. 8.

Further to improving the performance of the circuit in FIG. 8, an extra transistor, M10 is added to each stage of the circuit as shown in FIG. 9. The reason to have M10 in each stage is to ensure that node c in each stage can be pulled to the VSS1 level under all conditions. M10 is connected in parallel with M9 except that its gate is connected to the node c of the stage next to the followling stage. In this way, for example, the node c1 can surely be pulled to the VSS1 level when node c3 is pulled to the high voltage level. Similar explanation can be applied to the stage 2 through stage 240. Note that two dummy stage stages 241 and 242, in which nodes c241 and c242 are connected to the gates of M10 in stage 239 and 240, respectively, can also be added to the circuit. In practice, the power supply VCC, the high voltage VDD of the control signals, and negative power supplies (ground lines) VSS and VSS1 should all be adjusted according to the data driving scheme. For example, if a column inversion scheme is used, a VCC of 10 to 25 voltags should be chosen, and the ground line voltage levels should then be 0 and −10 volts. All ground lines, i.e. VSS and VSS1, should preferably be kept separated from each other to reduce any noise introduced by the circuit.

As those skilled in the art may understand, the pulse width of the the above control and clock signals are determined according to the timing budget of the operation, device characteristics and the sizes of the thin-film transistors. The size of the TFT should also be optimized to meet the performance requirement.

The operation of the row select driver in accordance with the present invention has been described above in relation to a scanning time interval of 63 us for a 384×240 pixel array display interfacing with the NTSC TV system. It should be understood that this is only an example of one embodiment of this invention and other embodiments and timing schemes can be used without departing from the invention hereof. For example, displays other than for TVs or with greater or lesser resolution can be incorporated within the scope of the present invention.

Given that all the key timing and voltage level control signals are derived from external ICs, this circuit provides the convenience and flexibility for optimizing the display system. Furthermore, because of the simplicity of the circuit in operation, this row driver circuit integrated into the display substrate should result in a good production yield.

There has been disclosed a novel select driver circuit for a display device, particularly an LCD display, that employs thin-film transistors that can be deposited on a substrate such as glass together with the display TFT array, and which reduces the number of row driving input leads substantially, from some predetermined number such as 240 in the example given herein to 10 lines. Thus, the advantage of the disclosed driver circuitry is that it reduces the number of external lead connections and significantly solves the display (such ass AMLCD) assembly arid packaging problems due to the limitation of the connector pitch. Furthermore, it reduces the number of external driver ICs required for driving row lines.

What is claimed is:

1. A circuit for use with a liquid crystal display (LCD) wherein said LCD display contains a matrix of picture elements (pixel) arranged in a first number of pixel columns and second number of rows on a substrate, said circuit comprising:

a plurality of row select driver circuits corresponding to said number of pixel rows for electrically energizing said pixel rows, said row select driver circuits being deposited on the LCD display substrate, wherein an output of each of said row select driver circuits is electrically connected to a corresponding pixel row and to a succeeding row select driver circuit as an activating input; and switching means external to the LCD display and having leads electrically connected to said row select driver circuits for providing:

first three clock signals S1,o; S2,o; S3,o to all odd-numbered rows having a period twice as long as the horizontal scanning time of the display, second three clock signals S1,e; S2,e; S3,e to all even-numbered rows lagging said first three clock signals respectively by said horizontal scanning time, a shift-in clock signal SDIN coupled to only the input terminal of first row select driver circuit, said first three clock signals, second three clock signals and said shift-in clock signals causing an output signal from each row select driver circuit such that each pixel row is sequentially energized.

2. The circuit of claim 1, wherein the number of leads from the switching means is less than the number of pixel rows.

3. The circuit of claim 1 wherein each of said row select driver circuits includes a plurality of thin-film transistors interconnected to cause sequential activation of each pixel row.

4. The circuit of claim 3 further including:

a first row select driver circuit stage activating a first pixel row for a first predetermined period of time; and a second adjacent row select driver circuit stage activating a subsequent pixel row for a second predetermined period of time such that a longer row select time is provided for each row to charge or discharge the pixels of the corresponding pixel row.

5. The circuit of claim 1 wherein the substrate is glass.

6. The circuit of claim 1 wherein:

the clock signal S2,o lags but overlaps partially with clock signal S1,o, and the clock signal S3,o overlaps totally with clock signals S1,o and S2,o.

7. The circuit of claim 6 wherein the clock signals S3,o S3,e are of opposite polarity to clock signals S1,o, S2,o, S1,e and S2,e.

8. The circuit of claim 1 wherein the output signal from each row select driver circuit energizes a corresponding pixel row and acts as a shift signal to the succeeding row select driver circuit.

9. The circuit of claim 8 wherein each row select driver circuit includes:

a transistor M1 and a transistor M2 connected in series between a positive power supply and a first negative power supply with the gate of M1 connected to said S1,o clock signal for odd-numbered stages and to said S1,e clock signal for even-numbered stages, and with the gate of M2 connected to an input terminal;

a transistor M3 and a transistor M4 connected in series between said positive power supply and said input terminal with the gate M3 connected to said S1,o clock signal for odd-numbered stages and to said S1,e clock signal for even-numbered stages, the gate of M4 connected to said S2,o clock signal for odd-numbered stages and to said S2,e clock signal for even-numbered stages;

a transistor M6 and a transistor M5 connected in series between a second negative power supply terminal and said S3,o clock signal for odd-numbered stages and S3,e clock signal for even-numbered stages terminal, with the gate of M5 connected to the common node between M3 and M4, the gate of M6 connected to the common node between M1 and M2, and the common node between M5 and M6 connected to said row output and the input terminal of the next stage.

10. The circuit of claim 9 wherein an additional transistor M7 is connected in parallel with M6 with the gate of M7 connected to S1,o for odd-numbered stages and to S1,e for even-numbered stages.

11. The circuit of claim 9 wherein two additional transistors M8 and M9 are connected between said clock signal S3,o for odd-numbered stages or said clock signal S3,e for even-numbered stages and said first negative power supply terminal with the input terminal to the next stage connected to the common node between M8 and M9 instead of the common node between M5 and M6.

12. The circuit of claim 11 wherein an additional transistor M7 is connected in parallel with M6 with the gate of M7 connected to the clock signal S1,o for odd-numbered stages or the clock signal S1,e for even-numbered stages.

13. The circuit of claim 8 wherein each row select driver circuit includes:

a transistor M1 and a transistor M2 connected in series between a positive power supply terminal and a first negative power supply terminal with the gate of M1 connected to said S1,o clock signal for odd-numbered stages and to said S1,e clock signal for even-numbered stages, and with the gate of M2 connected to an input terminal;

a transistor M3 and a transistor M4 connected in series between said input terminal and said first negative power supply terminal with the gate of M4 connected to the common node between M1 and M2, and the gate of M3 connected to said S2,o clock signal for odd-numbered stages and to said S2,e clock signal for even-numbered stages;

a transistor M6 and a transistor M5 connected in series between a second negative power supply terminal and said S3,o clock signal for odd-numbered stages and said S3,e clock signal for even-numbered stages with the gate of M6 connected to the gate of M4 and the gate of M5 connected to the common node between M3 and M4;

a transistor M7 connected in parallel with M6 with the gate connected to said S1,o clock signal for odd-numbered stages and to said S1,e clock signal for even-numbered stages.

14. The circuit of claim 13, wherein a transistor M9 and transistor M8 are connected in series between said first nagative power supply, and said S3,o clock signal for odd-numbered stages and said S3,e clock signal for even-numbered stages with the gate of M8 connected to the gate of M5 and the gate of M9 connected to the gate of M6.

15. The circuit of claim 14, wherein a transistor M10 is connected in parallel with M9 with the gate of M10 connected to the output terminal of the stage next to the following stage.

* * * * *